United States Patent [19]

Baker et al.

[11] 4,200,410

[45] Apr. 29, 1980

[54] CABLE LAYING DEVICE

[76] Inventors: Edward S. Baker, 717 S. Birch Pl.; Richard M. Talley, 2123 S. 1st Pl., both of Broken Arrow, Okla. 74012

[21] Appl. No.: 906,250

[22] Filed: May 15, 1978

[51] Int. Cl.[2] ..... E02F 5/02; F16L 1/00

[52] U.S. Cl. ..... 405/182; 405/181; 37/193; 172/40

[58] Field of Search ..... 405/181, 182, 183, 176–180; 172/40; 37/193, DIG. 18; 299/37

[56] References Cited

U.S. PATENT DOCUMENTS

| | | | |
|---|---|---|---|
| Re. 26,718 | 11/1969 | Kelley | 405/180 |
| 333,114 | 12/1885 | Dougine | 405/179 |
| 3,032,903 | 5/1962 | Ede | 405/181 X |
| 3,286,476 | 11/1966 | Maclay | 405/183 X |
| 3,348,383 | 10/1967 | Kelley | 405/181 |
| 3,405,533 | 10/1968 | Fries | 405/182 |
| 3,508,411 | 4/1970 | Rogers | 172/40 X |
| 3,515,222 | 6/1970 | Kant | 405/183 X |
| 3,608,322 | 9/1971 | Kinnan et al. | 405/182 |
| 3,684,030 | 8/1972 | Lucero | 37/193 X |
| 3,706,207 | 12/1972 | Cornelius et al. | 405/181 |
| 3,726,099 | 4/1973 | Ruge | 172/40 X |
| 3,757,529 | 9/1973 | Kaercher | 405/176 |
| 3,777,500 | 12/1973 | Kelley | 172/40 X |
| 3,802,210 | 4/1974 | D'Andrea | 405/178 |
| 3,849,999 | 11/1974 | Coffey | 405/178 |
| 4,040,261 | 8/1977 | Schuck et al. | 172/40 X |
| 4,117,890 | 10/1978 | Youngers | 172/40 |

*Primary Examiner*—Dennis L. Taylor

*Attorney, Agent, or Firm*—Clarence A. O'Brien; Harvey B. Jacobson

[57] ABSTRACT

A device is disclosed for excavating a trench in frozen or unfrozen soil and introducing cable within the trench thereby excavated. An integral vibrating or reciprocally moving blade breaks frozen soil and cuts roots, and trench depth, as well as blade angle of attack is controllable by means of an eccentric mounting structure for the blade. Angulated projections on each side of the blade lift soil from the trench formed, and a vertically adjustable connection between the blade and a following cable laying guide maintains proper elevational relationship therebetween.

12 Claims, 10 Drawing Figures

CABLE LAYING DEVICE

BACKGROUND OF THE INVENTION

1. Field of the Invention

The invention pertains to earth working equipment, more particularly to a device for attachment behind a towing vehicle, the device comprising a trench forming blade for lifting soil and a cable laying guide associated with the blade assembly. The blade assembly vibrates vertically and has an eccentric mounting structure for connecting the blade to its supporting structure for vertical adjustment while maintaining a desired angle of attack. The cable laying guide has a vertically adjustable connection with the blade assembly for maintaining proper elevational relationship therebetween.

2. Description of the Prior Art

Cable laying plows are known having vibratory means or vertically oscillatable sawing means mounted on the plow forward edge. Cable laying plows are also known with means for maintaining a desired angle of attack. The following patents exemplify the state of the prior art:

U.S. Pat. Nos: 3,802,210—Apr. 9, 1974, 3,348,383—Oct. 24, 1967, 3,777,500—Dec. 11, 1973, 3,608,322—Sept. 28, 1971, 3,726,099—Apr. 10, 1973, 3,405,533—Oct. 15, 1968, 3,286,476—Sept. 30, 1963.

None of these patents, however, discloses the specific structure of the cable laying device of the present invention, nor is any device illustrated therein specifically adapted for use with frozen soil. Furthermore, these devices fail to provide a combination of an efficient blade angle of attack, a soil elevator, and cable laying guide attachment means so as to cause the soil to raise while simultaneously maintaining a suitable cable laying guide angle, with the result that such deficiencies in prior art devices cause the cable to bend or drop as it exits from the guide, resulting in undesirable permanent cable deformation.

SUMMARY OF THE INVENTION

It is accordingly an object of the present invention to provide an efficient soil raising device for cutting and forming a trench, into which a metal cable is continuously deposited parallel to ground level without damage to the cable.

It is another object of the invention to provide vibratory trench cutting means with an improved mounting structure providing vertical adjustment while maintaining a desired angle of blade attack.

A further object of the invention is to provide vibratory blade cutting means adaptable for use with frozen soil which contain roots, vegetation, and the like.

Another object of the invention is to provide a trench cutting blade with angulated projections on each side of the blade for raising soil from the trench formed by the blade.

Still another object of the invention is to provide in combination with a trench cutting blade a cable laying guide associated with the blade, the cable laying guide having a vertically adjustable connection with the blade to maintain proper elevational relationship between the blade and guide.

Yet another object of the invention is to provide a soil lifting blade having one or a plurality of blade cutting attachments for the purpose of allowing the blade to excavate a trench through soil frozen to a certain depth from the ground surface.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
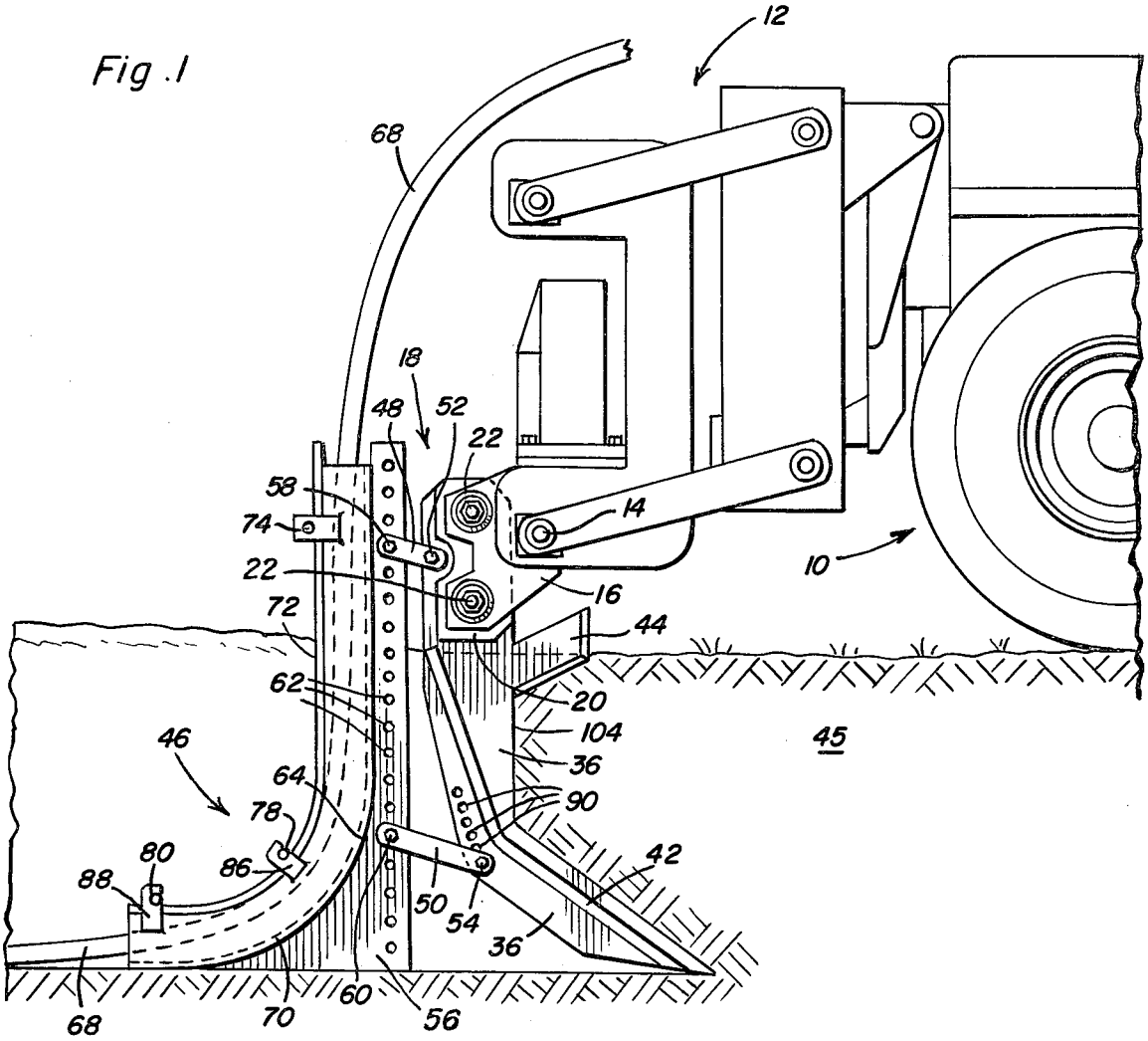
FIG. 1 is a side elevational view of the device of the present invention when attached to vibratory mounting means carried by and suspended upon the rear of a towing vehicle shown fragmentarily.
Figure 2:
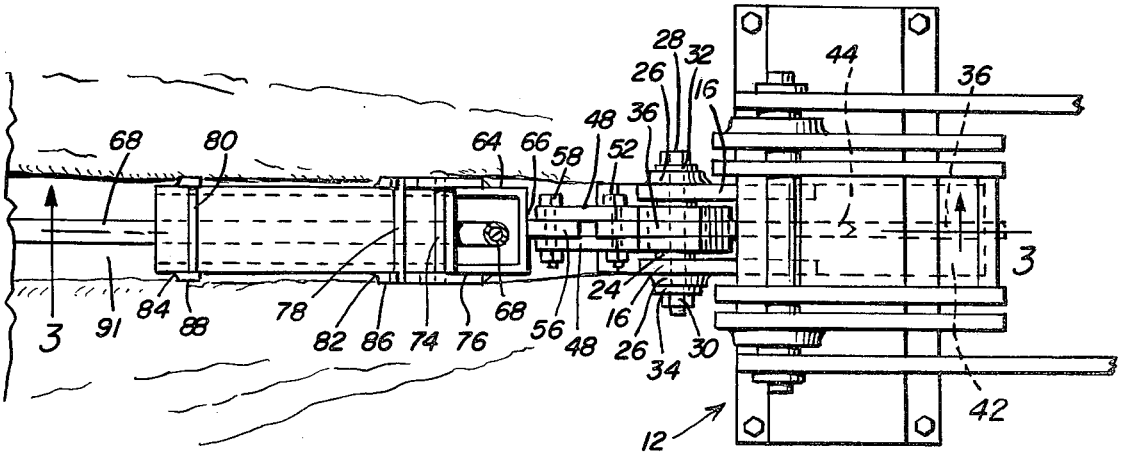
FIG. 2 is a top plan view of the device of FIG. 1, showing in broken outline the trench cutting blade assembly of the present invention.

Referring now more particularly to the drawings, FIG. 1 shows a towing vehicle 10 to which is attached conventional mounting and vibrating means 12 for a trench cutting device. Mounting and vibrating means 12, of both conventional construction and operation, transmits vertically reciprocatory motion through pivot 14 to bracket 16 of blade mounting means 18, comprising brackets 16 on each side of mounting base 20, held to brackets 16 by eccentric cam bolts 22. Washers 24 maintain mounting base 20 in spaced centered alignment between brackets 16. To strengthen brackets 16 at the points of greatest stress, namely where bolts 22 pass through brackets 16, brackets 16 are provided with upraised platforms 26 for mounting of bolts 22. Each bolt 22 has head 28 and nut 30, with associated washers 32 and 34, respectively. Trench cutting blade 36 is attached to mounting base 20 by explosion bonding, riveting, bolting or other means (not shown).

Figure 3:
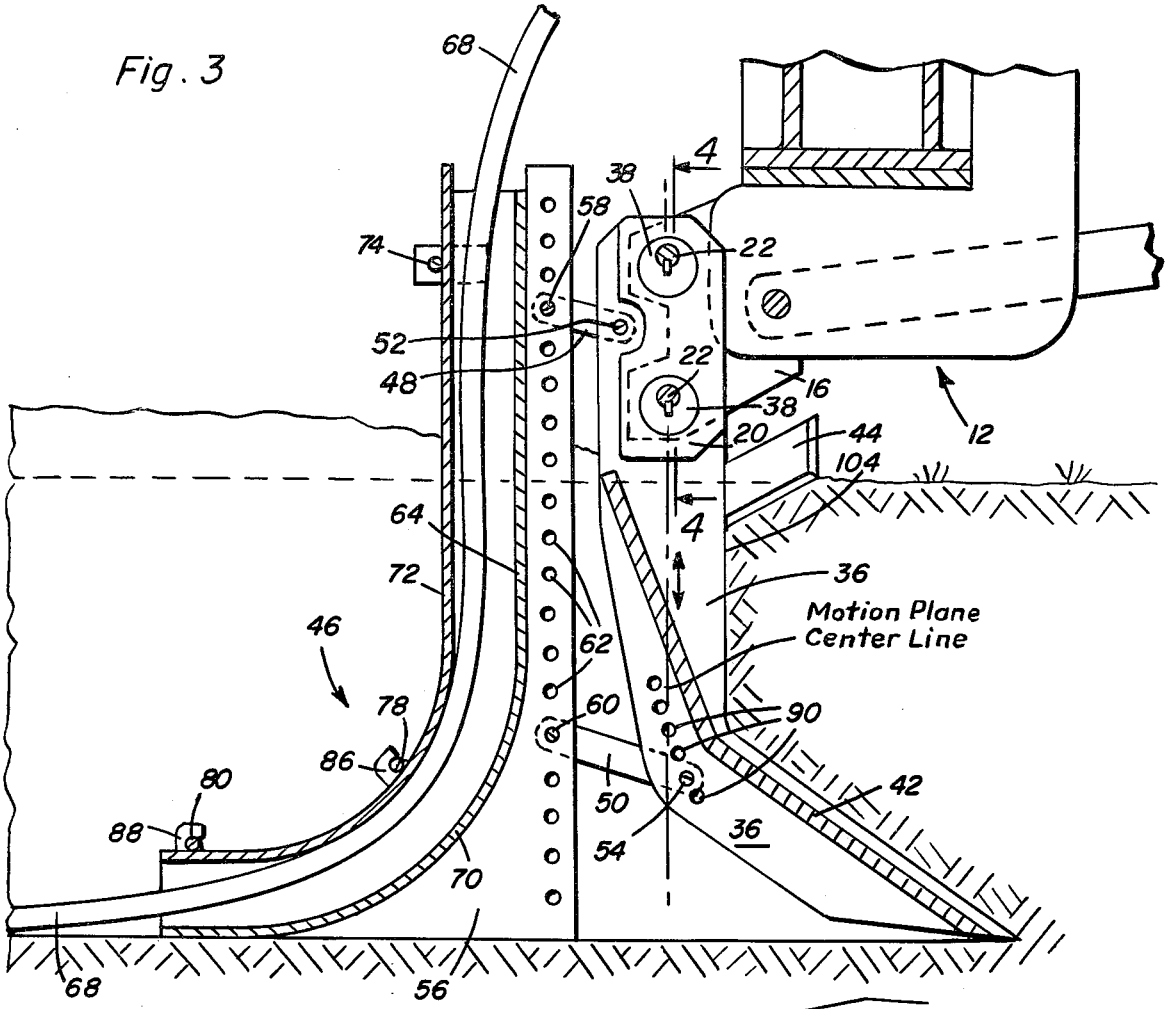
FIG. 3 is a sectional view taken substantially upon a plane passing along section line 3—3 on FIG. 2, showing details of the trench cutting blade and associated cable laying guide.
Figure 4:
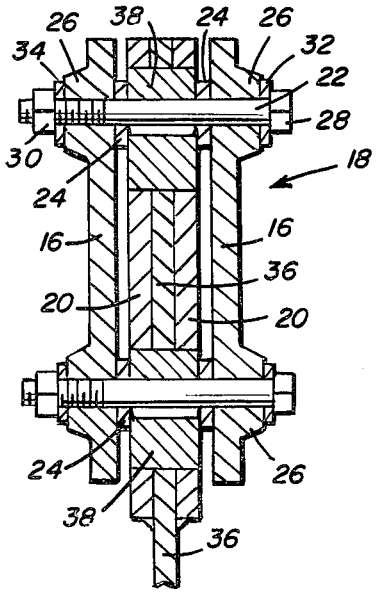
FIG. 4 is a vertical sectional view taken substantially upon a plane passing along section line 4—4 on FIG. 3, showing details of the mounting assembly of the trench cutting blade.
Figure 5:
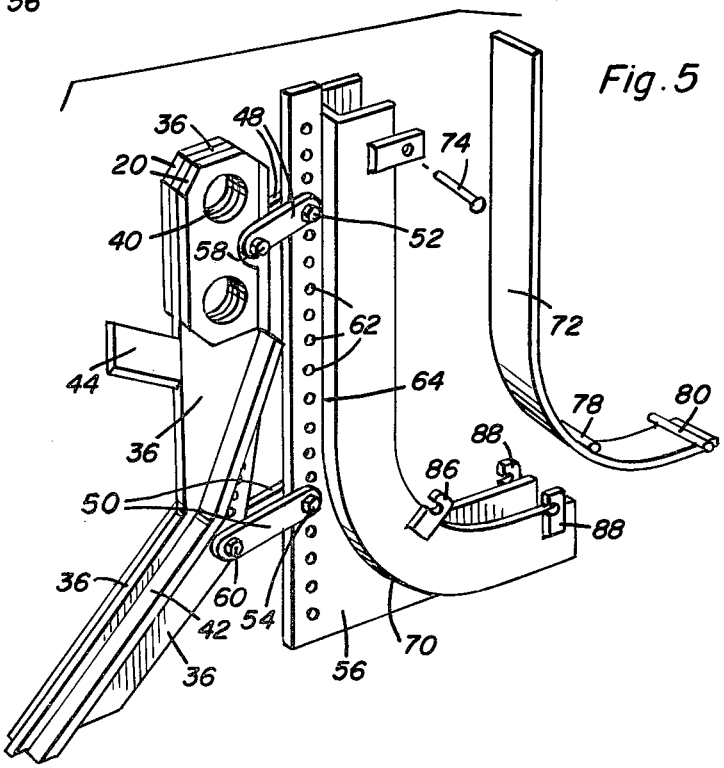
FIG. 5 is a group perspective view of the trench cutting blade and associated cable laying guide, showing disassembled components.

Eccentric cams 38 are inserted within cam blade attach holes 40 and are keyed to bolts 22. FIG. 3 shows cams 38 in the position providing maximum upward elevation of trench cutting blade 36. Rotation of cams 38 permits blade 36 to be used for several depths of trenches, the depth depending on the degree of equal rotation of cams 38. Unequal rotation of cams 38 alters the attack angle of blade 36. In all cases, the attack angle blade 36 can be maintained at the optimum attack angle, which is very critical for efficient excavation of soil to form a trench. Blade 36 has an associated elevator 42, an angulated projection for lifting soil upwardly to form a trench.

In the embodiment of the invention shown in FIGS. 1 and 3, projection 44 is shown for initial breaking of the upper portion soil 45. Trench cutting blade 36 is attached to cable laying guide 46 through pivotable chute attach straps 48 and 50, attached to trench cutting blade 36 at pivot pins 52 and 54, respectively, and attached to guide bar 56 of cable laying guide 46 at pivot pins 58 and 60, respectively. A plurality of vertically aligned equally spaced holes 62 along guide bar 56 permits selection of attachment of pins 58 and 60 as desired. Cable laying chute 64 is welded to guide bar 56 at weldments 66, and contains cable 68. The lower portion 70 of chute 64 describes the arc of a circle and conforms with compatibly shaped guide bar 56. Cable guide retaining strip 72 conforms with the backward surface of chute 64, and is adapted for convenient disassembly from the remainder of cable laying guide 46 in order to insert or remove cable 68 as necessary. Disassembly of retaining strip 72 is accomplished by removal of retaining pin 74, which passes through keeper 76 after retaining pins 78 and 80 have been seated in notches 82 and 84 of latches 86 and 88. Keeper 76 and latches 86 and 88 are welded to chute 64, and pins 76 and 78 are welded to retaining strips 72. Blade 36 also contains a plurality of holes 91 for attachment of bar 50. Trench 90 is formed through soil 45 by rightward motion of blade 36 and associated elevators 42, with simultaneous downward feeding of cable 68 through cable laying guide 46.

Figure 6:
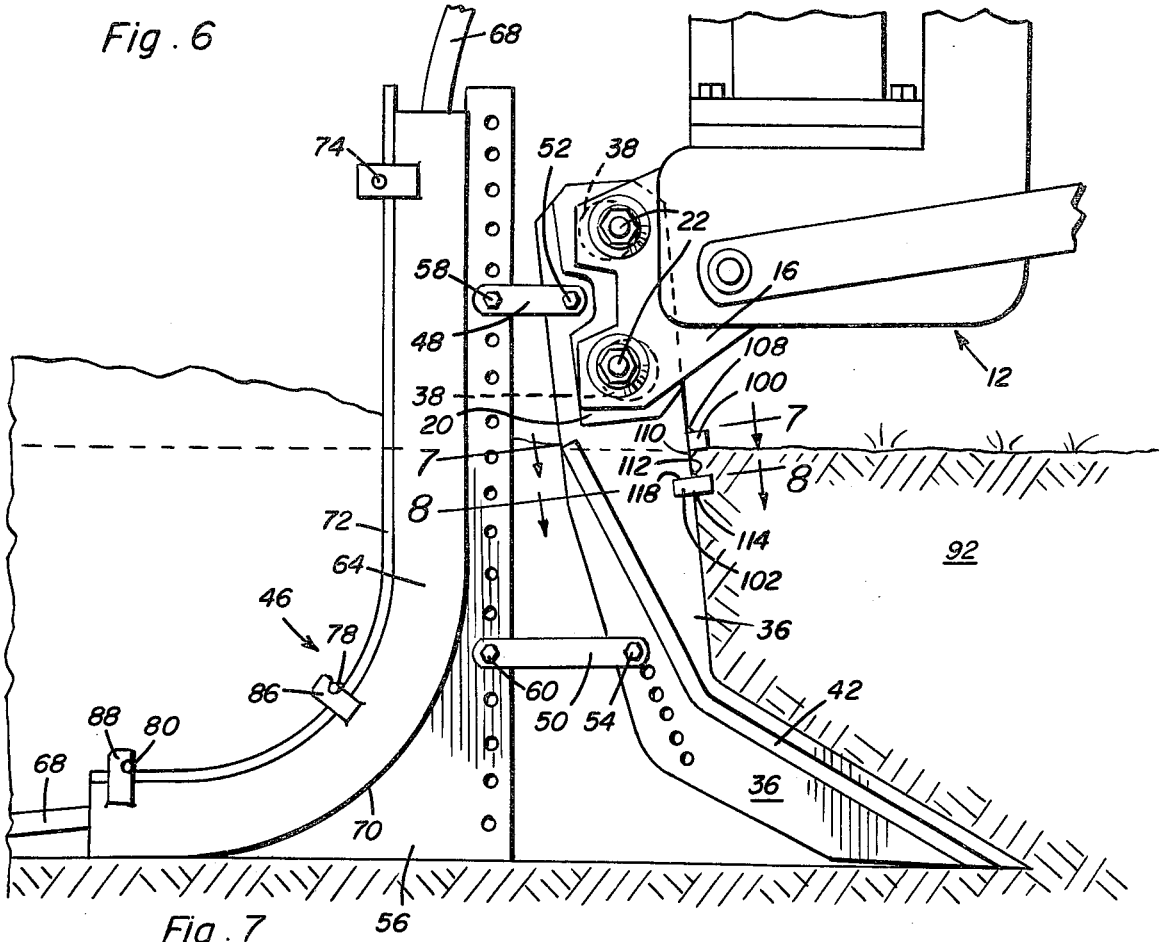
FIG. 6 is a side elevational view of a second embodiment of the present invention, showing sod breaking teeth on the forward edge of the trench cutting blade.
Figure 7:
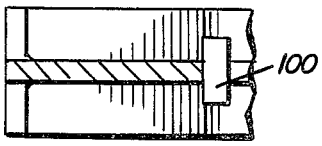
FIG. 7 is a top sectional view of a trench cutting blade, taken substantially upon a plane passing along section line 7—7 of FIG. 6., showing an associated sod breaking blade attachment.
Figure 8:
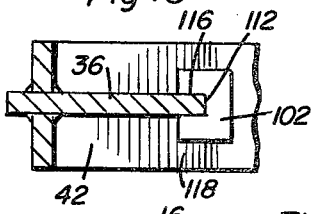
FIG. 8 is a top sectional view of a of a trench cutting blade, taken substantially upon a plane passing along section line 8—8 of FIG. 6, showing a different sod breaking blade attachment.
Figure 9:
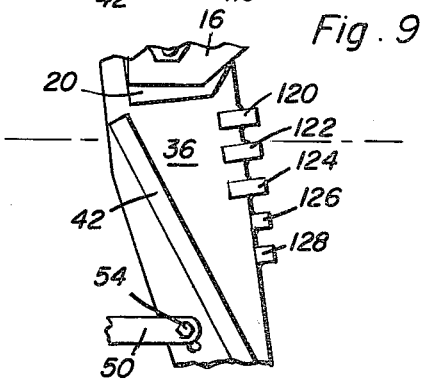
FIG. 9 is a fragmentary side elevational view of a third embodiment of the invention, showing a trench cutting blade with a plurality of blade cutting attachments thereon.

In a second embodiment of the invention, projection 44 for cutting of soil 45 near the soil surface is absent. Instead, the forward edge of blade 36 is provided with soil breaking teeth, which can take the form of thin blade sod breaker tooth 100 or of wide trough blade sod breaker tooth 102. The forward edge 104 of blade 36 is inclined from the vertical from the embodiment shown in FIG. 6 to present an angle of attack to soil 45 as shown. The angle of attack can be varied by rotation of cams 38. Also, controllable by appropriate rotation of cams 38 is the depth of the trench formed in soil 45. Comparison of FIG. 6, having a slightly inclined forward edge 104, with FIG. 1, having a vertical forward edge 104, shows that chute attach straps 50 and chute attach straps 48 are connected at a different hole selected from holes 62 and at a different hole 90 on blade 36. Proper selection of the point of attachment of straps 48 and 50 provides the bottom surface 106 of cable laying guide 46 parallel to ground level and parallel to the bottom of the trench excavated. In the embodiment shown in FIG. 6, two sod breaking teeth are shown. Sod breaking tooth 100 is welded to blade 36 at welds 108 and 110. Tooth 102 is welded to blade 36 at welds 112 and 114, but additionally is welded about the sides of blade 36 at welds 116 and 188. A plurality of sod breaking teeth can be attached to blade 36, as shown in FIG. 9, where three wide sod breaking teeth 120, 122 and 124 are shown, along with two narrow teeth 126 and 128.

Figure 10:
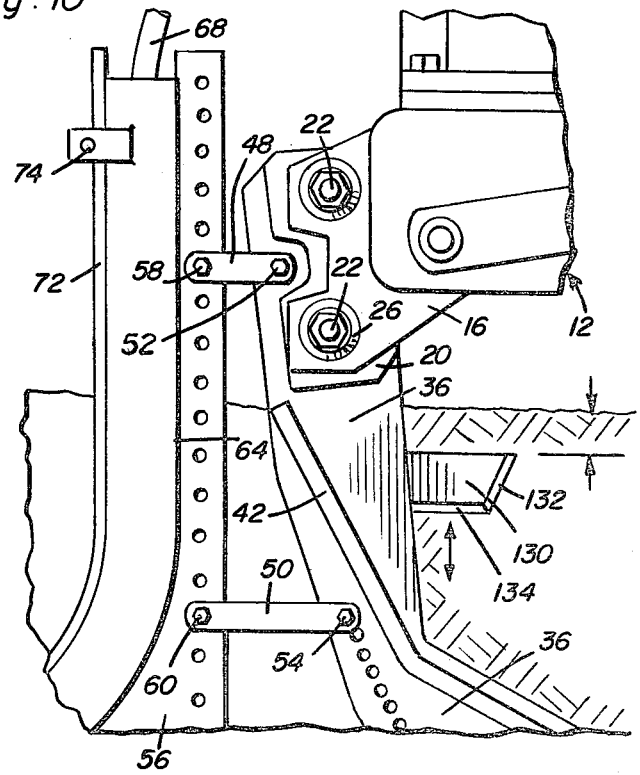
FIG. 10 is a side elevational view of the present invention, showing a fourth embodiment of a trench cutting blade having a sod breaking attachment.

FIG. 10 shows a fourth embodiment of the present invention, where projection 130 is provided below the level of soil 45 and has sharpened edges, with edge 132 in the forward direction and edge 134 in the downward direction. Projection 130 is particularly useful during operation when the upper portion of soil 45 is frozen.

The angle presented by blade 36 to soil 45 is critical for successful excavation of a trench. This attack angle cannot be closely regulated or controlled by the angle of mounting of vibrator boom 12. Therefore, adjustment of eccentric cams 38 permits excavation of a trench at an angle of attach of blade 36 appropriate for the particular soil 45 being excavated. At the same time, straps 48 and 50 maintain the bottom of cable laying guide 46 parallel to the ground while allowing vertical motion as cable laying guide 46 conforms to the bottom of the trench formed by blade 36. The present invention permits cable 68 to exit from the cable laying guide 46 so as not to scuff, bend, or drop the cable as it exits from chute 64. The result is a considerable improvement in efficiency with vibratory plowing. In addition, use of sod breaking teeth permits a sawing action resembling that of a saber saw, particularly useful for breakage of frozen soil. While such sawing action is applicable only for vibratory plowing, the embodiments of the present apparatus having cutting projections, rather than sod breaking teeth, can be successfully used when applied to static plowing, as well as vibratory plowing.

For any of the projections, teeth, or equivalent structures on the forward edge 104 of blade 36, attachment to forward edge 104 can be by welding, bolting, screwing, riveting, or other attaching means. Such projections, teeth, burrs, or other attachments for cutting or sawing the soil can be of unitary construction with blade 36, as well as attached to blade 36. Many suitable patterns and combinations of width and spacing of such blocks or blades can be used, taking into consideration the width and size of blade 36, the depth of trench excavated, the power available through vibrator boom 12 and vehicle 10, the nature of soil 92 and other factors.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In a cable laying device including excavating means having a blade for forming a trench in soil and cable laying means for laying cable in said trench rearwardly of said blade, the improvement comprising mounting means for said blade, said blade forming said trench to a predetermined depth and having a forward edge presenting a predetermined angle of attack to said soil, said mounting means having adjusting means for adjusting said depth and for adjusting said angle of attack, the adjusting means being adapted for selectably adjusting either said depth at the same predetermined angle of attack or for adjusting the predetermined angle of attack at the same depth, whereby said predetermined angle of attack can be maintained at the optimum attack angle for efficient excavation of soil to form said trench, the device further including rigid connecting means for maintaining said cable laying means in spaced relation to said excavating means, said rigid connecting means permitting vertical movement of said cable laying means without change of the angle presented by said cable laying means to said soil.

2. In a cable laying device including excavating means for forming a trench and a cable laying means for laying cable in said trench rearwardly of said blade, the improvement comprising mounting means for said blade, said blade forming said trench to a predetermined depth and having a forward edge presenting a predetermined angle of attack to said soil, said mounting means having adjusting means for adjusting said depth while maintaining said angle of attack, together with connecting means for maintaining said cable laying means in spaced relation to said excavating means, said connecting means permitting vertical movement of said cable laying means without change of the angle presented by said cable laying means to said soil, said adjusting means comprising two eccentric cams adjustably mounted within vertically arranged mounting holes in the upper portion of said blade.

3. The device of claim 2 wherein said connecting means comprises an upper linkage and a lower linkage, the upper linkage pivotally connecting said cable laying means to said excavating means and said lower linkage pivotably connecting said cable laying means to said excavating means.

4. The device of claim 3 together with a cutting projection on the forward edge of said blade for cutting through said soil.

5. The device of claim 3 together with a sod breaking tooth on said blade for sawing through said soil.

6. The device of claim 4 wherein said blade has an upper portion near the surface of said soil, said projection being located on said forward edge and on or near said upper portion of said blade.

7. The device of claim 4 wherein said projection comprises a flat substantially horizontal blade attachment lying in a plane perpendicular to a plane passing through said blade.

8. The device of claim 7 wherein said blade attachment presents an upward angle from said blade.

9. The device of claim 7 wherein a plurality of said blade attachments is attached in spaced relation to said blade.

10. The device of claim 4 wherein said blade has laterally extending wings adapted to raise said soil upwardly to form said trench.

11. The device of claim 11 wherein said wings have an upper end above said trench.

12. The device of claim 3 wherein said blade has laterally extending wings adapted to raise said soil upwardly to form said trench.

* * * * *